US008397402B2

(12) United States Patent
Lucas et al.

(10) Patent No.: US 8,397,402 B2
(45) Date of Patent: Mar. 19, 2013

(54) SHOE HAVING LEVERED CUSHIONING SYSTEM

(75) Inventors: Timothy David Lucas, Herzogenaurach (DE); Gerd Rainer Manz, Weisendorf (DE); Matthew Daniel Chandler, Cambridge (GB); Paul Leonard Michael Smith, Nürnberg (DE); Josh Robert Gordon, Nürnberg (DE); Manfred Rippel, Bad Windsheim (DE); Robert Leimer, Nürnberg (DE); Jan Hill, Groβenseebach (DE)

(73) Assignee: adidas International Marketing B.V., Amsterdam (NL)

( * ) Notice: Subject to any disclaimer, the term of this patent is extended or adjusted under 35 U.S.C. 154(b) by 1191 days.

(21) Appl. No.: 11/959,041

(22) Filed: Dec. 18, 2007

(65) Prior Publication Data

US 2008/0155861 A1 Jul. 3, 2008

(30) Foreign Application Priority Data

Dec. 18, 2006 (DE) ..... 10 2006 059 658

(51) Int. Cl.

| | |
|---|---|
| ***A43B 13/18*** | (2006.01) |
| ***A43B 7/32*** | (2006.01) |
| ***A43B 21/26*** | (2006.01) |
| ***A43B 21/32*** | (2006.01) |

(52) U.S. Cl. ..... 36/28; 36/25 R; 36/27; 36/34 R; 36/35 R; 36/37; 36/38; 36/92; 36/102; 36/103; 36/105; 36/113

(58) Field of Classification Search ..... 36/103, 36/92, 105, 113, 34 R, 35 R, 37, 38, 102, 36/25 R, 27, 28, 29

See application file for complete search history.

(56) References Cited

U.S. PATENT DOCUMENTS

| | | | | |
|---|---|---|---|---|
| 1,597,792 | A * | 8/1926 | Hoff et al. | 280/11.14 |
| 1,613,538 | A * | 1/1927 | Schad | 36/7.8 |
| 2,475,092 | A * | 7/1949 | Harrell | 36/7.8 |
| 4,351,538 | A * | 9/1982 | Berta | 280/11.26 |
| 4,492,374 | A * | 1/1985 | Lekhtman et al. | 482/77 |
| 4,756,095 | A * | 7/1988 | Lakic | 36/2.6 |
| 4,894,934 | A | 1/1990 | Illustrato | |
| 5,131,173 | A * | 7/1992 | Anderie | 36/25 R |
| 5,282,325 | A * | 2/1994 | Beyl | 36/27 |

(Continued)

FOREIGN PATENT DOCUMENTS

| | | |
|---|---|---|
| DE | 693 03 833 T2 | 9/1996 |
| DE | 20 2004 015 909 U1 | 1/2005 |

(Continued)

*Primary Examiner* — Khoa Huynh
*Assistant Examiner* — Tiffany Drake
(74) *Attorney, Agent, or Firm* — Sterne, Kessler, Goldstein & Fox, P.L.L.C.

(57) ABSTRACT

The present invention relates to a shoe, in particular a sports shoe, with a cushioning system comprising a lower sole element and an upper sole element. The cushioning system further comprises at least one lever having at least two arms where an angle α between the arms lies within the range $0° < \alpha < 180°$. The first arm is connected to a deformation element and the second arm is connected to one of the two sole elements, wherein the lever is pivotably arranged at the other sole element.

31 Claims, 4 Drawing Sheets

U.S. PATENT DOCUMENTS

| | | | | |
|---|---|---|---|---|
| 5,464,380 | A * | 11/1995 | Ikeda et al. | 601/29 |
| 5,701,685 | A * | 12/1997 | Pezza | 36/7.8 |
| 6,553,692 | B1 | 4/2003 | Chung | |
| 6,684,531 | B2 * | 2/2004 | Rennex | 36/27 |
| 7,314,125 | B2 * | 1/2008 | Smaldone et al. | 188/372 |
| 7,377,055 | B2 * | 5/2008 | Bramani | 36/15 |
| 2003/0154628 | A1 | 8/2003 | Gyr | |
| 2005/0005472 | A1 * | 1/2005 | Perenich | 36/27 |
| 2006/0065499 | A1 | 3/2006 | Smaldone et al. | |

FOREIGN PATENT DOCUMENTS

| | | | |
|---|---|---|---|
| DE | 102 34 913 | B4 | 11/2005 |
| DE | 10 2004 033 611 | A1 | 2/2006 |
| DE | 10 2005 006 267 | B3 | 3/2006 |
| DE | 10 2006 059658.7 | | 12/2006 |
| WO | WO 2005/025381 | A1 | 3/2005 |

* cited by examiner

SHOE HAVING LEVERED CUSHIONING SYSTEM

BACKGROUND OF THE INVENTION

1. Field of the Invention

The present invention relates to a shoe, in particular a sports shoe with a cushioning system.

2. Background Art

Shoe soles are subjected to substantial compressive loads. Particularly in sports shoes, there are ground reaction forces resulting when the shoe contacts the ground with the heel and during push-off at the end of the step cycle exceed the body weight. Accordingly, a sole construction must on the one hand provide a sufficient cushioning comfort to avoid premature fatigue or even injuries of the muscles or the bones. On the other hand, it must be capable to withstand these forces over an acceptable lifetime.

In sports shoes, for example running shoes, cushioning elements made out of foamed materials such as ethylene-vinyl-acetate (EVA) are typically arranged in the sole. Although this material provides good cushioning properties, it has a limited lifetime. For example runners with a high monthly mileage must replace their running shoes after only a few months. Further disadvantages are the temperature dependency of the cushioning properties of EVA and the comparatively high weight.

Therefore, applicant developed shoe soles in the past, for example those disclosed in DE 102 34 913 A1 and DE 10 2005 006 267 B3, wherein the conventional foamed cushioning elements are at least partly replaced by structural deformation elements without EVA. The disclosures of DE 102 34 913 A1 and DE 10 2005 006 267 B3 are incorporated in their entirety herein by reference thereto. However, the structural deformation elements tend to be slightly stiff and in a similar manner to foamed EVA cushioning elements only provide a limited cushioning movement. From a theoretical point of view, the complete height at which the foot is positioned above the ground surface is available for a cushioning movement, for example, during ground contact with the heel. Practically, however, only a fraction of the distance to the ground can actually be used for the cushioning movement, since the compressed cushioning material takes up a significant residual volume below the sole of the foot. As a result, there might be a so called "bottoming out", in case of peak loads, if the cushioning material is fully compressed which excludes any further cushioning movement. If the initial volume is increased, the shoe becomes unstable and a spraining to the side may cause severe injuries. Furthermore, the increased amount of cushioning material leads to a greater weight of the shoe, which is undesirable for most sports shoes.

U.S. Pat. No. 4,894,934 to Illustrato discloses an arrangement for the heel part of a shoe wherein two leaf spring-like surfaces are pivotably attached to each other. The centers of the two surfaces are interconnected by a rubber element which is elongated under a compression of the heel part and thereby provides a restoring force. This design is very complex and leads to a substantial residual volume which restricts the available cushioning movement.

U.S. Pat. No. 6,553,692 to Chung discloses a complex arrangement for the heel part of a shoe which transforms a compression movement in the sole into a compression or elongation of a horizontally arranged coil spring. Also here there is a significant residual volume of the cushioning system so that the explained difficulties are not avoided. Furthermore, the design is so complex that it is inconceivable to economically manufacture the corresponding shoe.

U.S. Published Application No. 2006/0065499 to Smaldone et al. discloses an arrangement having several toggle levers transforming a compression in the heel of a shoe into a linear movement so that a star-like elastic element is radially elongated. The design of the toggle levers is complex and requires the assembly of a plurality of straight rods having lugs at their ends for receiving a plurality of axles. Furthermore, the star-like elastic element is arranged exactly in the center of the construction between the outer surfaces of the cushioning element. In this position it can easily be damaged and causes an accumulation of dirt which impairs the cushioning movement.

Embodiments of the present invention are therefore based on the problem to provide a shoe with a cushioning system, which can be cost-efficiently manufactured and which overcomes the above mentioned disadvantages of the prior art by using a greater part of the given thickness of a sole for a cushioning movement.

BRIEF SUMMARY OF THE INVENTION

Embodiments of the present invention solve this problem by a shoe, in particular a sports shoe, with a cushioning system comprising a lower sole element and an upper sole element. The cushioning system further comprises at least one lever having at least two arms where the angle $\alpha$ between the arms lies within the range $0<\alpha<180°$. The first arm is connected to a deformation element and the second arm is connected to one of the two sole elements, wherein the lever is pivotably arranged at the other sole element.

The arrangement of the angled lever and the deformation element according to embodiments of the present invention serves to transform a vertical cushioning movement in the shoe sole into a deformation movement of the deformation element. This is because the vertical cushioning movement of the upper sole element in the direction of the lower sole element causes a rotation of the lever and thereby a deformation of the deformation element attached to the first arm of the lever. This leads to maximum use of the available space between the sole elements. In contrast to the simple compression of cushioning materials such as EVA or the above mentioned designs of the prior art, the arrangement of the angled lever allows the exclusion of almost any residual volume between the two sole elements. Accordingly, a long cushioning movement is made possible without the sole becoming excessively thick. The above explained "bottoming out" can therefore be reliably avoided and the muscles and joints of an athlete are protected without increasing the risk of spraining the ankle and the weight of the shoe. At the same time, the life-time of the shoe is significantly increased. Due to the angled shape of the lever, the vertical compression movement is transformed into a deformation movement by a single component. The manufacturing effort of the arrangement of embodiments of the present invention is therefore substantially lower than in the prior art mentioned above.

In an embodiment of the present invention, the deformation element is a horizontally extending elongation element and the angle $\alpha$ is in a range of $5° \leqq \alpha \leqq 125°$, for example approximately 90°. Both, the angle $\alpha$ and the relative lengths of the first and second arm influence, to what extent the vertical cushioning movement is transformed into the elongation movement of the elongation element when the shoe is under load. Specific examples of the elongation elements used in further embodiments are elastic strips or coil springs. However, other types of deformation, such as compression, torsion, etc. are also conceivable and can be realized with the design of the present invention.

A particularly advantageous cushioning characteristic can be achieved, if the angled lever is shaped such that a vertical cushioning movement by a distance x of the upper sole element in a downward direction approaching the lower sole element leads to an elongation of the elongation element by a distance y, wherein the distance y is less than the distance x. In other words, a vertical cushioning movement, when the shoe is loaded, e.g. during the first ground contact with the heel, is effectively reduced to a smaller elongation movement of the elongation element. Such a reducing transformation of the vertical cushioning movements allows comparatively long vertical cushioning paths without an excessive elongation movement. As a result, large and therefore comfortable cushioning movements can be realized with a comparatively compact arrangement of the described cushioning system of the shoe.

In an embodiment, the angled lever is pivotably arranged at the periphery of the upper sole element and the deformation element is preferably arranged directly below the upper sole element. For a given thickness of the overall shoe sole, the cushioning mechanism thereby provides a greater cushioning path than the described designs of the prior art. Furthermore, the space between the two sole elements is essentially void and does therefore not tend to become clogged by dirt which could hinder the cushioning movement. In other embodiments this design can be reversed, i.e., the angled lever can be pivotably arranged at the periphery of the lower sole element, while the deformation element is arranged directly above the lower sole element.

In an embodiment, the cushioning system comprises at least two angled levers, which are arranged on opposite sides of the shoe, for example, on the lateral and the medial side of the heel part. In one embodiment, there are lateral and medial deformation elements which can be deformed essentially independently from each other. Mis-orientations such as pronation or supination can simply be corrected by using different deformation elements for the medial and the lateral side. Such a modular design also allows a manufacturer, a retailer or even the user to adapt the shoe to the individual needs of the user and/or a specific type of sport. Further, such a modular design generally facilitates the manufacture of the shoe using a suitable toolbox and the required parts.

In one embodiment, the lower sole element is provided as a sole surface and the upper sole element as a sole cup adapted to the anatomy of the foot. As a result, the pressure is distributed over essentially the complete area so that point loads on the foot sole are excluded. Apart from an additional outsole layer, which is preferably arranged directly on the lower side of the lower sole surface, the sole comprises preferably no further components in this region. Thus, the improved cushioning properties can be achieved at a comparatively low overall weight of the shoe. In some embodiments, a conventional outsole element can be attached under the lower sole element. Similarly, the upper sole element can be attached to a conventional midsole or insole, or the like.

In some embodiments, a foamed deformation element or one of the above mentioned structural deformation elements can be arranged in the rearmost heel part. In another embodiment, the angled lever is arranged in the heel part of the shoe such that the elongation of the elongation element essentially determines the cushioning properties of the shoe during the first ground contact with the heel. In one embodiment, two levers are arranged in an angled configuration in the rearmost section of the heel part for cushioning during ground contact with the heel.

Further additional features of the shoe according to the invention are defined in further dependent claims.

BRIEF DESCRIPTION OF THE DRAWINGS

The accompanying figures, which are incorporated herein and form part of the specification, illustrate a shoe. Together with the description, the figures further serve to explain the principles of the shoe described herein and thereby enable a person skilled in the pertinent art to make and use the shoe.

DETAILED DESCRIPTION OF THE INVENTION

In the following, embodiments of the invention are further described with reference to a sports shoe. However, it is to be understood that the present invention can be used in a plurality of different types of shoes. The invention is particularly relevant for shoes which are subjected to high loads, for example continuous loads such as in a running shoe or peak loads such as in a basketball shoe.

Figure 1:
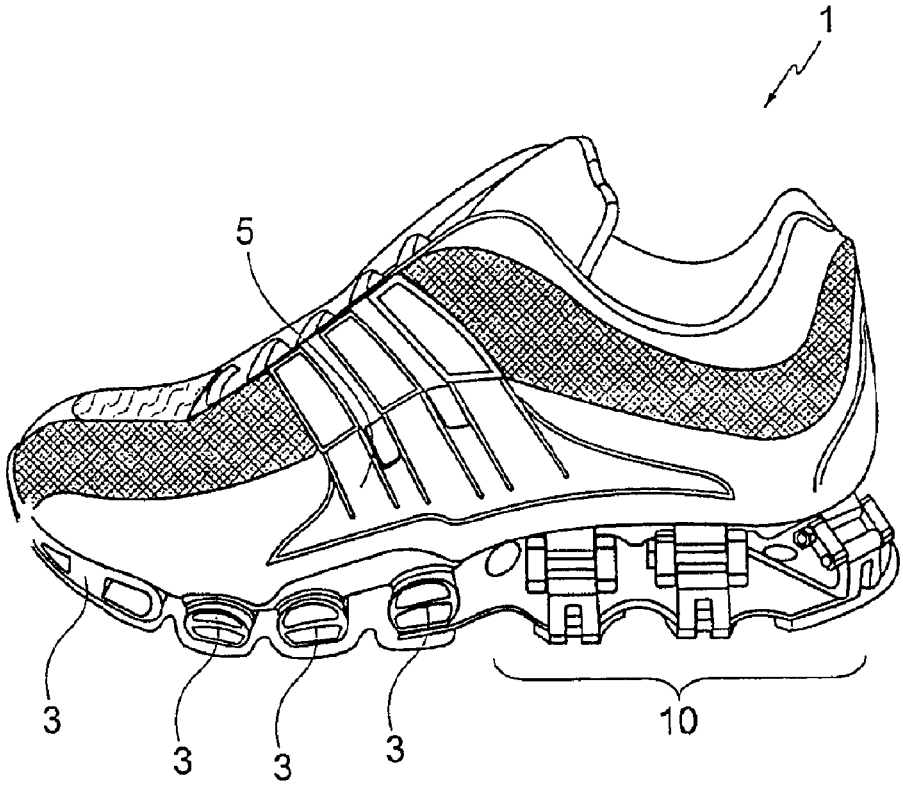
FIG. 1 is an overall view of an embodiment of a sports shoe with a cushioning system according to the present invention.

FIG. 1 presents a side view of a shoe 1 having in the rear part of the sole a cushioning system 10 which is further explained below. It is also possible to arrange the cushioning system 10 in the forefoot part or in other parts of the sole. However, the highest ground reaction forces occur in the heel part which makes an optimal cushioning system particularly important.

Figure 2:
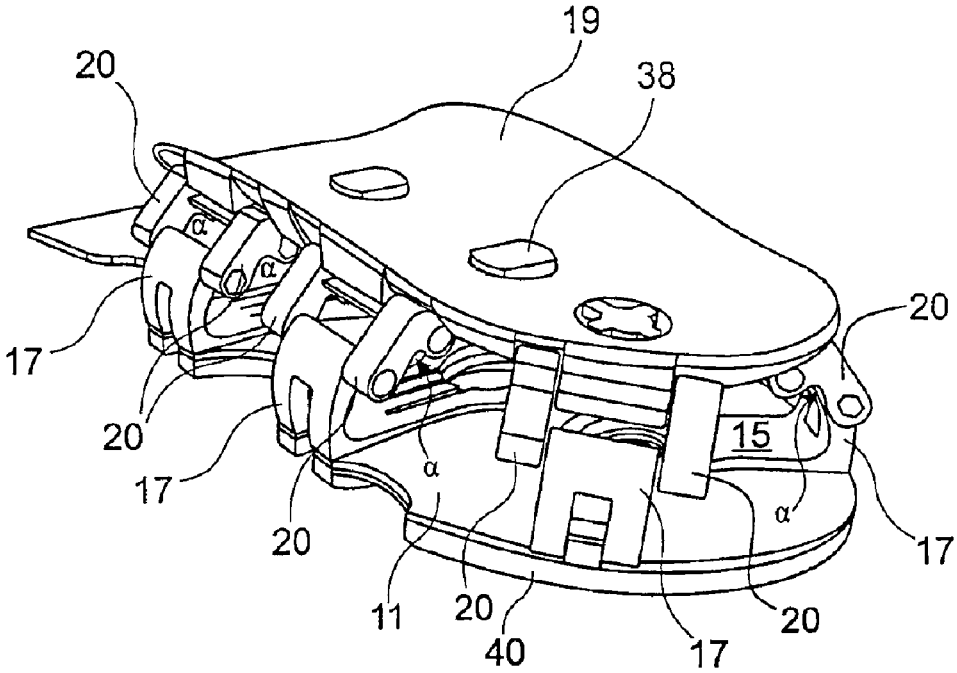
FIG. 2 is a rear perspective view of the cushioning system in the heel part of the shoe of FIG. 1.
Figure 3:
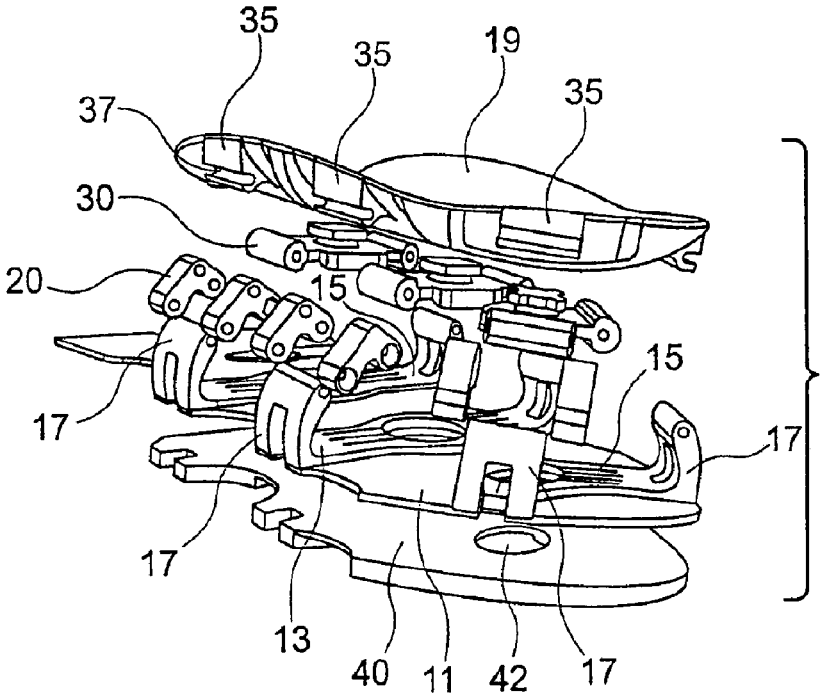
FIG. 3 is an exploded view of the components of the cushioning system of FIG. 2.
Figure 4:
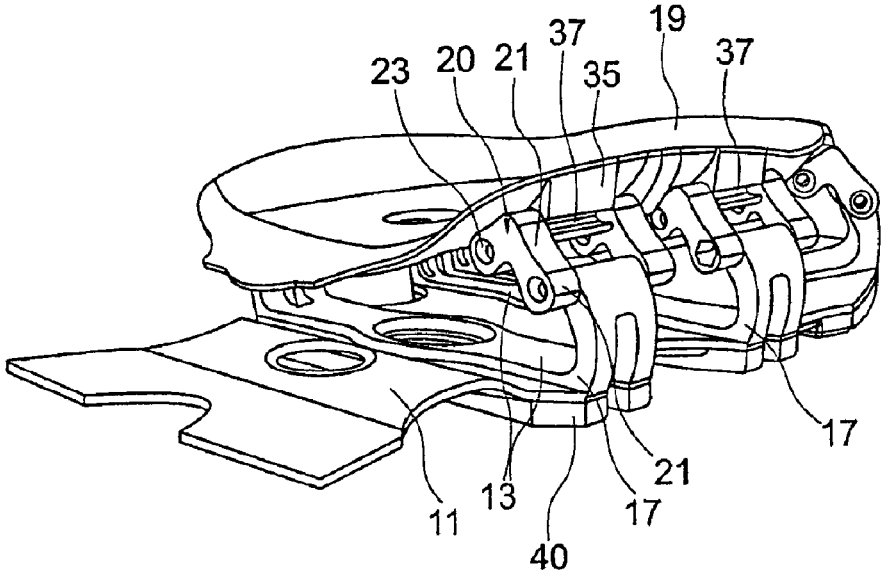
FIG. 4 is a front perspective view of the cushioning system of FIG. 2.
Figure 5:
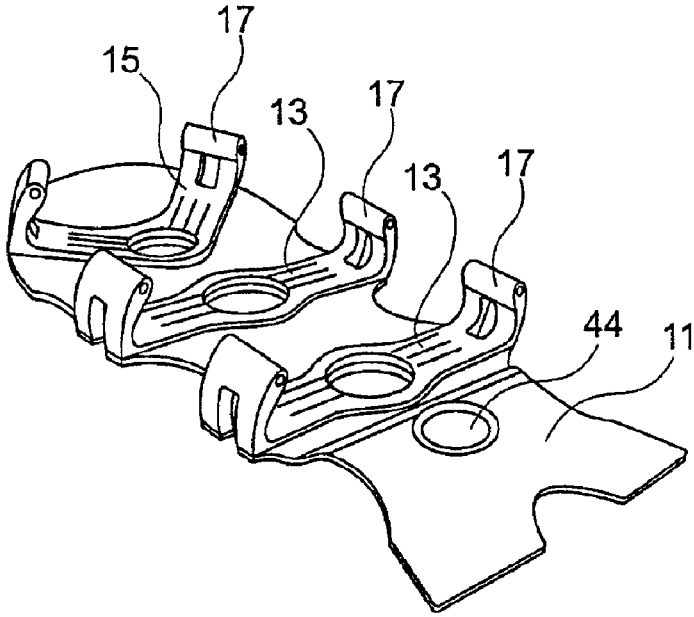
FIG. 5 is a front right perspective view of the lower sole surface and the L-shaped spacer elements in the embodiment of the present invention shown in FIGS. 1 to 4.

Standard cushioning elements are preferably arranged in the forefoot part of the shoe 1, as shown in FIG. 1, for example foamed elements (not shown) or the structural deformation elements 3 without foamed material, which are disclosed in the above mentioned DE 102 34 913 A1 of applicant. Other alternatives are hybrids of foamed and structural elements or air/gel bladders. However, it is to be understood that the specific cushioning system described in the following can also be arranged in the forefoot part or in the whole area of the shoe sole. The design of the shoe upper 5 of the shoe of FIG. 1 is conventional and therefore not further discussed in the following. FIGS. 2 to 4 present detailed views of a cushioning system 10. A plurality of essentially L-shaped spacer elements are arranged on a lower sole surface 11. Whereas the two pairs of spacer elements 13 in the front part of the heel each extend transversely over the lower sole surface 11 (i.e. from the medial to the lateral side), the pair of rear spacer elements 15 has an angled configuration, as best seen in FIG. 5. Depending on the design of the overall systems, in an embodiment of the present invention there could also be L-shaped spacer elements only on one side or only in the rearmost part of the heel. The spacer elements 13, 15 reinforce the lower sole surface 11 and are therefore preferably made from a highly stable plastic material such as glass-fibre polyamide, or other composite materials, for example reinforced with carbon fibres. Other alternatives are the use of lightweight metals such as aluminum or hybrid materials, and/or a combination of plastics and metals.

At their outer ends, the spacer elements 13, 15 have essentially vertical sections 17. The height of the vertical sections 17 determines to a large extent the thickness of the sole, i.e. the distance between the lower sole surface 11 and the upper sole surface 19 as best seen in FIGS. 2 to 4. Exemplary values for basketball shoes are approximately 18 mm for the rear foot and 8 mm for the forefoot, whereas a running shoe might have a thickness of approximately 24 mm in the rear foot and 12 mm in the forefoot, for example. The greater the thickness, the longer the cushioning path, i.e., the distance which is available for the cushioning movement.

An arm 21 of the rigid angled lever 20 is pivotably arranged at the upper end of each vertical section 17 of the spacer elements 13, 15, as best seen in FIG. 4. As best seen in FIG. 3, another arm 23 is connected to an elastic strip 30. At the intersection of the two arms 21, 23, the angled lever 20 is pivotably attached to the upper sole surface 19. To this end, the upper sole surface 19 comprises on its lower side a plurality of projections 35 having groove-like recesses 37 for receiving a rotation axle (not shown). This facilitates the manufacture, since the rotation axle only needs to be clipped into the recesses 37. Although not shown, it is within the scope of the present invention to pivotably attached angled lever 20 on the lower sole surface 19. In this embodiment, the spacer elements could be attached on the upper sole surface 19 and extend vertically downward.

Other arrangements, wherein the rotation axle extends through one or more bearing lugs (not shown) of the projections 35, are also conceivable. Further, there may be no continuous rotation axle but other means to pivotably attach the lever 20 to the upper sole surface 19, for example small projections engaging corresponding recesses (not shown). The rotational interconnection of the upper end of the vertical section 17 and the arm 21 of the lever 20 can be similarly designed. The same applies for the attachment of the elastic strip 30 to the end of the other arm 23, as best seen in FIG. 3. Although there is a high degree of constructional freedom, the mentioned interconnections should be sufficiently stable to withstand the considerable pressure and tension loads, which may occur during the cushioning movement, as is further explained below.

The two arms 21 and 23 are arranged with an angle $\alpha$ (not shown) between them. For example, in one embodiment, angle $\alpha$ can be in the range of from about 5° to about 125°. In another embodiment, angle $\alpha$ is substantially 90°. Instead of providing two essentially straight arms 21, 23, which define a certain angle $\alpha$, a curved arrangement of the lever 20 is also conceivable, as long as it is mechanically equivalent, i.e., leads to the same paths of motion of the sole surfaces and the endpoints of the elongation element when the shoe sole is loaded.

As can be seen in FIGS. 2 to 4, two angled levers 20 are arranged in one embodiment on either side of the vertical section 17. Accordingly, a common rotation axle (not shown) can be used which extends through the upper end of the vertical section 17. The two levers 20 could be made integral with the rotation axis (not shown) which clips into projection 35. In an embodiment, as shown in FIGS. 2-4, four levers 20 are arranged on each side of the sole. As best seen in FIG. 2, there are four additional levers 20 at the two vertical sections 17 of the spacer element 15, which are particularly used during the first ground contact with the rearmost section of the heel part.

However, in other embodiments, there might be only a single lever or pair of levers at the rearmost section of the heel part for cushioning the ground reaction forces during footfall. In this case, conventional cushioning elements, such as the above described foamed elements, the structural elements or combinations thereof, for example a PU shell with a foam interior, can be arranged in other sections of the heel part of the shoe sole. In a related embodiment, two pairs of levers are arranged in a slightly angled configuration, wherein one pair of levers occupies the lateral rearmost section of the heel part and the other the medial rearmost section of the heel part. Such a design provides an optimal load distribution for the ground contact, even if the shoe is not perfectly oriented but slightly tilted to the side, as it is for example the case for many runners. Another alternative is the arrangement of three, approximately equally spaced levers or pairs of levers in the rearmost section of the heel part, one in the centre and the other two on the medial and the lateral side, respectively.

Further, it is also conceivable to arrange the described levers only on one side of the shoe sole (medial or lateral) and to use conventional cushioning elements on the other. In view of the above, it is apparent for the person skilled in the art that there is a wide variety of possibilities how to arrange one or more of the described levers.

A pressure load on the sole design shown in FIGS. 2 to 5 leads to a movement of the upper sole surface 19 in direction of the lower sole surface 11. Due to the sole surface 11 and the comparatively rigid spacer elements 13 and 15 arranged thereon, a one-sided or localized load is distributed over a greater area. The movement of the upper sole surface 19 leads to an inwardly directed rotation of the angled lever 20. As a result, the end of the arm 23 of each lever 20 moves downwardly and outwardly which leads to an elongation of the strip 30. Therefore, the vertical cushioning movement of the upper sole surface 19 is transformed into an essentially horizontal elongation of the strip 30 using only a limited number of components. The achieved cushioning properties are on the one hand determined by the geometry of the angled lever 20, in particular the relation of the lengths of the arms 21 and 23, and on the other hand by the elastic properties of the strip 30. The materials for the strips 30 are, for example, elastomeric materials and/or rubber materials/compounds. These materials have, for example, spring constants between 10 and 80 N/m per side (medial and lateral).

In one embodiment, the cushioning movement is reduced by the present invention, i.e., a decrease of the vertical distance of the two sole surfaces 11 and 19 by a first amount leads to an elongation of the strip 30 from its center to its lateral or medial end by a second amount, which is less than the first amount. This is particularly the case if the arm 21 is longer than the arm 23 and if the angle between the two arms is substantially 90°. As a result, greater cushioning movements can be realised without the elongated strip 30 requiring excessive transversal dimensions of the overall cushioning system 10. However, the opposite design is also possible (not shown), wherein the arm 23 is longer than the arm 21 so that the resulting elongation of the elongation element 30 is greater than the cushioning movement in vertical direction. A smaller elongation allows a more compact design of the overall cushioning system, whereas a greater elongation of the elongation element allows the use of less rigid elongation elements. As one of skill in the art would readily appreciate, the cushioning movement can be customized by altering the length of the two arms 21 and 23 and also by altering the angle between the two arms.

Since, in one embodiment, the vertical sections 17 are arranged at the periphery of the lower sole surface 11, the lever 20 can perform an almost unlimited inwardly directed rotation. When the lever 20 rotates around its rotational axle (not shown), which extends essentially parallel to the longitudinal axis of the shoe, the upper sole surface 19 moves downward but stays within the boundaries of the vertical sections 17. In contrast to the prior art, the cushioning system of the invention is therefore not arranged between the two sole surfaces 11 and 19, but essentially adjacent thereto and cushions their relative movement from the outside. The space directly below the upper sole surface 19 is essentially free from components of the cushioning system 10 so that cushioning movements are, in contrast to the prior art, only limited by the lower sole surface 11 contacting the strip 30 arranged directly below the upper sole surface 19. The fraction of the overall thickness of the sole, which is available for a cushioning movement, is therefore significantly greater than in the prior art. Although not shown, the cushioning system just described can be inverted. In other words, the vertical sections 17 can be arranged at the periphery of the upper sole surface 19 and extend downwardly. In this embodiment, levers 20 are pivotally connected to the lower sole surface 19.

In one embodiment, as an additional security feature, a foam element or another cushioning structure (not shown) could be arranged in the empty space below the upper sole surface 19 to avoid a direct contact of the upper sole surface 19 with the lower sole surface 11, in case of extreme peak loads.

In one embodiment, the strip 30 comprises a projection 38 in its center anchoring the strip in a corresponding opening of the upper sole surface 19, as best seen in FIG. 2. This facilitates the assembly and essentially decouples the elongation on the lateral side from the elongation on the medial side. If an elongation strip 30 is used having different properties on the medial and the lateral side, mis-orientations such as pronation or supination can be selectively addressed. In general, a replacement of one or more elongation strips 30 is an easy way for modifying the cushioning properties of the shoe. If the strip 30 can be easily detached from the end of the arm 23, such a modification may even be performed by the wearer of the shoe, if, for example, a strip has become too soft or torn or if a different cushioning characteristic is desired.

In general, any element which elongates under tension can be used as an elongation element for the present invention, which elongates under tension, regardless of its material or structure or whether the elongation is fully elastic or whether its elongation characteristic is linear or progressive.

In one embodiment, the sole surface 19 is anatomically adapted to the shape of the foot sole, i.e. it is shaped in the heel like a cup or cradle. This assures a high degree of wearing comfort without excessive point loads. Furthermore, additional sole layers are preferably arranged on top of the upper sole surface 19, which are explained below with reference to the embodiment shown in FIG. 6.

In one embodiment, an outsole 40 is arranged directly below the lower sole surface 11, as best seen in FIG. 3, providing the required grip and wear resistance. The outsole 40, as well as other components of the described cushioning system, are preferably provided with cut-outs in regions, which are less prone to abrasion in order to reduce material and thereby the overall weight of the described sole design as much as possible. Furthermore, the cut-outs 42 in the outsole 40 and the corresponding cut-outs 44 in the lower sole surface 11, as best seen in FIG. 5, facilitate that dirt, which accumulated in the inner space between the upper and lower sole surface, automatically falls downwardly when lifting the sole from the ground and therefore can not impair the cushioning movement during the following ground contact.

Figure 6:
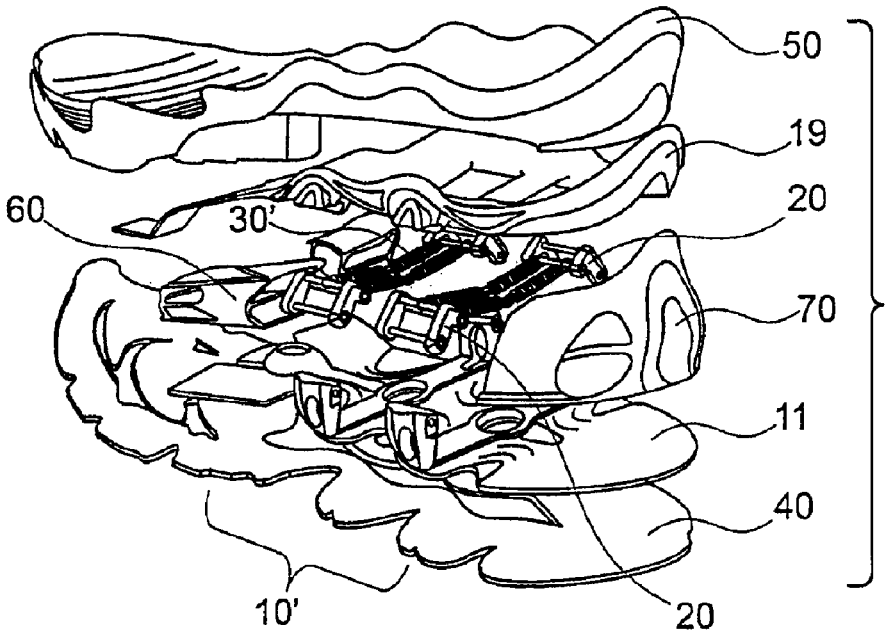
FIG. 6 is an exploded view of an embodiment of the present invention.

FIG. 6 shows a further embodiment of the present invention and illustrates in addition the integration of the cushioning system in the overall sole ensemble. This integration is independent from the specific embodiment of the cushioning system and can therefore also be used for the embodiment discussed with reference to FIGS. 2 to 5.

As can be seen, a thin mid-sole layer 50 is arranged on top of the upper sole surface 19 having in the front part of the shoe the typical thickness of a common mid-sole. As a result, the direct contact of the foot with the comparatively hard upper sole surface 19 is avoided. The mid-sole 50 can be made from a common foamed material such as EVA and/or may comprise structural or other additional cushioning elements. If necessary, there may be an additional thin insole layer, e.g., a sockliner (not shown in FIG. 6) on top of the midsole.

FIG. 6 shows additionally that the outsole layer 40 extends preferably over the overall length of the shoe and further contributes to a stable integration of the cushioning system 10' in the sole design. The cushioning system is therefore sandwiched between the continuous mid-sole layer 50 and the continuous outsole layer 40. One or more additional structural deformation elements 60 may be arranged directly in front of the cushioning system having an approximately wedge-like shape and providing a smooth transmission between the cushioning system 10' and the thinner forefoot part.

Figure 7:
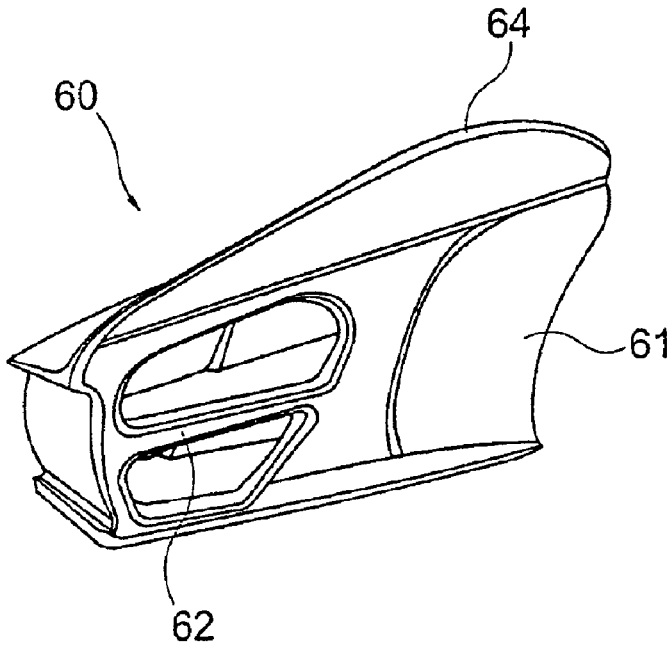
FIG. 7 is a perspective view of a deformation element according to an embodiment of the present invention.

The element 60 is shown in detail in FIG. 7. As can be seen, the element 60 comprises a side-wall 61, a top surface 64, supporting the continuous mid-sole layer 50 (or any other upper layers) of the sole ensemble and an intermediate surface 62. Overall, the element 60 has a framework structure, similar to the structural deformation element 70 which is arranged in the heel part and described in detail in the above mentioned DE 10 2005 006 267 B3 of applicant.

The cushioning system 10' shown in FIG. 6 differs from the embodiments of FIGS. 1-5 in several aspects: on the one hand the angled levers 20 are arranged only on the lateral and the medial side of the heel part and not in the rearmost section. In the rearmost section of the heel part there is a structural deformation element 70, as it is disclosed in the above mentioned DE 10 2005 006 267 B3 of applicant. Alternatively, it is also conceivable to arrange an EVA-element in this part of the sole or any other type of conventional cushioning element (not shown).

Furthermore, coil springs 30' are used in the embodiment of the cushioning system 10' shown in FIG. 6 instead of the elongation strips 30. The rotation of each pair of angled levers 20 leads to an elongation of a corresponding pair of two coil springs 30'. The ends of the coil springs 30' are preferably attached to the center of the lower side of the upper sole surface 19 (not shown in FIG. 6). As a result, the cushioning on the medial side is essentially decoupled from the cushioning on the lateral side. As in the case of the elongation strips 30, mis-orientations such as pronation or supination can be addressed by using coil springs 30' with different elastic properties on the lateral side compared to the medial side.

However, it is also conceivable to use continuous springs (or elastic strips) extending from the levers 20 on the lateral side all the way to the opposite levers on the medial side. If the same material is used, this leads to significantly softer cushioning characteristic of the shoe.

Figure 8:
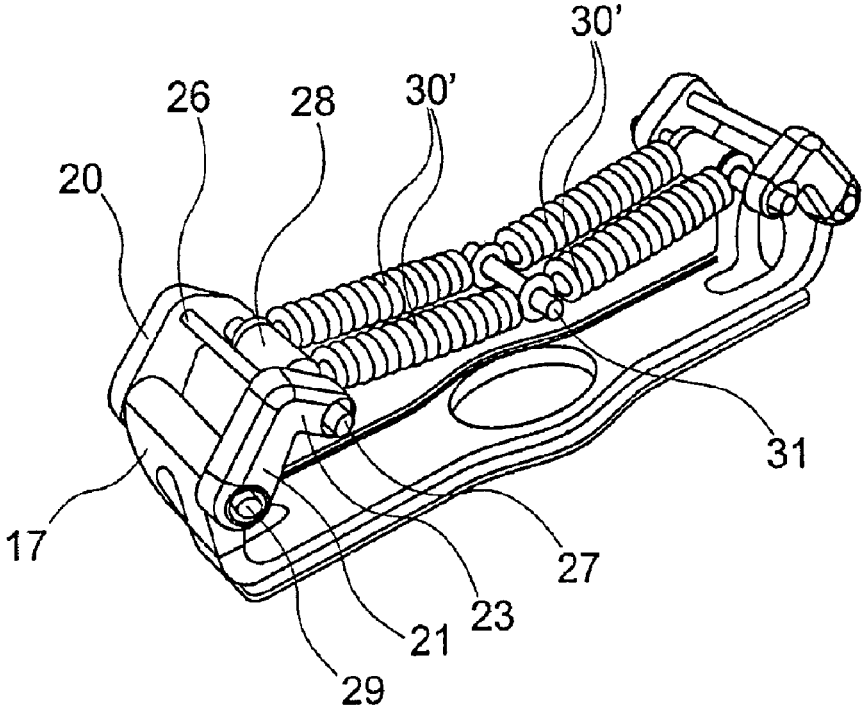
FIG. 8 is a perspective view of a portion of the embodiment of the present invention shown in FIG. 6.

One embodiment of the attachment of the coil springs 30' to the levers 20 is shown in detail in FIG. 8. As can be seen, two pairs of two coils springs 30' for the medial and the lateral side, respectively, are arranged between a medial and a lateral pair of levers 20. The two levers 20 of each pair are rotatably attached to the upper sole surface 19 (not shown in FIG. 8) by means of a common axle 26. The axle 26 can either extend through a suitably adapted bearing hole on the periphery of the upper sole surface 19 or it can be clipped into a corresponding recess. At the lower ends of the arms 23, there is another axle 27 interconnecting the two levers 20 of the respective pair, which serves to attach the end of the two coil springs 30'. A spacer 28 may be arranged between the attachments of the two coil springs 30' on the axle 27. Finally, there is a third axle 29 at the lower ends of the arms 21, which again interconnects the two levers and rotatably attaches them to the vertical section 17. The inner ends of the coil springs 30' furthest away from the levers 20 are interconnected by, for example, a bar 31, or by any other means, which may or may not be rigidly attached to the upper sole surface 19. If the bar 31 is fixed to the lower side of the upper sole surface 19 (not shown in FIG. 8), the elongation of the medial coil springs 30' is essentially independent from the elongation of the lateral coils springs 30'.

Although the attachment is described above with respect to the coils springs 30' of the embodiment of FIG. 6, it is to be noted that the elastic strips 30 of the first embodiment described further above can be arranged in more or less the same manner.

The coil springs 30' have generally more linear elastic properties than the above described elastic strips 30 made from elastomeric materials/rubber, which tend to show a more progressive, i.e., non-linear characteristic. Spring steel or other metal alloys used for the manufacture of the coil springs 30' have generally a longer life-time than the above mentioned elastic strips 30. However, the elastic strips are thinner than the coil springs 30' and therefore allow a greater cushioning path in view of the remaining space to the lower sole surface 11. Further, there is the risk that coil springs may become clogged with dirt, which is excluded for the elastic strips. To overcome this disadvantage, the coil springs 30' can be housed in tubes or recesses of the lower side of the upper sole surface 19 (not shown).

Apart from the arrangement shown in the Figures and discussed above, wherein the levers 20 and the strip 30 or the coils springs 30' are arranged at the upper sole surface 19, it is also conceivable to mirror the whole construction. In this case the essentially rigid spacer elements 13 and 15 extend downwardly from the upper sole surface 19 and the levers 20 and the elastic strip 30 are arranged at the lower sole surface 11.

While various embodiments of the present invention have been described above, it should be understood that they have been presented by way of example, and not limitation. It will be apparent to persons skilled in the relevant art(s) that various changes in form and detail can be made therein without departing from the spirit and scope of the present invention. Thus, the present invention should not be limited by any of the above described exemplary embodiments, but should be defined only in accordance with the following claims and their equivalents.

What is claimed is:

1. A shoe with a cushioning system comprising:

a lower sole element and an upper sole element;

a first lever comprising a first lever first arm and a first lever second arm, wherein said first lever first arm is connected to a first deformation element and said first lever second arm is connected to one of said upper sole element and said lower sole element, and wherein said first lever first arm and said first lever second arm are fixed relative to each other; and a second lever comprising a second lever first arm and a second lever second arm, wherein said second lever first arm is connected to a second deformation element and said second lever second arm is connected to the one of said upper sole element and said lower sole element, and wherein said second lever first arm and said second lever second arm are fixed relative to each other, wherein said first lever is pivotably coupled, about a longitudinal axis of the shoe, to the other of said upper sole element and said lower sole element at an intersection of said first lever first arm and said first lever second arm, wherein said second lever is pivotably coupled, about a longitudinal axis of the shoe, to the other of said upper sole element and said lower sole element at an intersection of said second lever first arm and said second lever second arm, wherein said first lever is arranged on a medial side of said shoe, and wherein said second lever is arranged on a lateral side of said shoe.

2. A shoe according to claim 1, wherein an angle $\alpha$ between said first lever first arm and said first lever second arm is in a range of 5 degrees $\leqq\alpha\leqq$125 degrees.

3. A shoe according to claim 1, wherein said first and second deformation elements are substantially horizontally extending elongation elements.

4. A shoe according to claim 3, wherein said first lever is shaped such that a vertical cushioning movement by a distance x of said upper sole element in a downward direction towards said lower sole element leads to an elongation of said first and second deformation elements by a distance y, wherein said distance y is less than said distance x.

5. A shoe according to claim 4, wherein said first lever is pivotably arranged on a periphery of said upper sole element or said lower sole element.

6. A shoe according to claim 1, wherein said first and second deformation elements are arranged directly below said upper sole element.

7. A shoe according to claim 1, wherein a rotation axle is attached to one of said upper or lower sole elements.

8. A shoe according to claim 1, wherein said first lever second arm is connected to the one of said upper sole element and said lower sole element via a spacer element.

9. A shoe according to claim 1, wherein said first lever and said second lever are arranged at a heel part of said shoe.

10. A shoe according to claim 1, wherein saidfirst and second deformation elements are configured to deform substantially independently from each other.

11. A shoe according to claim 1, wherein said first lever is arranged in a heel part of said shoe such that a deformation of said first and second deformation elements essentially determines cushioning properties of said shoe during a first ground contact with said heel part.

12. A shoe according to claim 11, wherein said first and second levers are arranged in an angled configuration in a rearmost section of said heel part for cushioning during ground contact with said heel part.

13. A shoe according to claim 1, wherein said lower sole element is provided as a sole surface.

14. A shoe according to claim 1, wherein said upper sole element is provided as a sole cup adapted to the anatomy of a foot.

15. A shoe according to claim 1, wherein said first and second deformation elements are either a coil spring or an elastic strip.

16. A shoe according to claim 1, wherein at least a portion of said upper and lower sole elements comprises glass-fibre reinforced polyamide or carbon fibres.

17. A shoe according to claim 1, wherein at least a portion of said first lever comprises glass-fibre reinforced polyamide or carbon fibres.

18. A shoe according to claim 8, wherein at least a portion of said spacer element comprises glass-fibre reinforced polyamide or carbon fibres.

19. A shoe according to claim 1, wherein an angle $\alpha$ between said first lever first arm and said first lever second arm is approximately 90 degrees.

20. A shoe with a cushioning system comprising:

a lower sole element;

an upper sole element:

a lever comprising a first arm and a second arm, the first and second arms defining a fixed angle therebetween at an intersection thereof, wherein the first arm is coupled to one of the lower sole element and the upper sole element at one of a medial side of the shoe and a lateral side of the shoe; and a deformation element coupled to the second arm and extending toward the other of the medial side of the shoe and the lateral side of the shoe, wherein the intersection of the first arm and the second arm is pivotably coupled to the other of the lower sole element and the upper sole element.

21. A shoe according to claim 20, wherein:

the lower sole element comprises a first vertical section disposed at the medial side of the lower sole element and a second vertical section disposed at the lateral side of the lower sole element, the first lever is coupled to the first vertical section, a second lever is coupled to the second vertical section, and the deformation element extends from the first lever to the second lever.

22. A shoe according to claim 5, wherein the first lever and the second lever are arranged opposite one another about a longitudinal axis of the shoe.

23. A shoe according to claim 20, wherein the deformation element comprises:

a first deformation element having an outer end coupled to the first lever; and a second deformation element having an outer end coupled to a second lever, wherein inner ends of the first and second deformation elements are coupled together and fixed to the upper sole element.

24. A shoe according to claim 1, wherein said first and second deformation elements together form a single continuous deformation element.

25. A shoe according to claim 1, wherein said first and second deformation elements are separate elements.

26. A shoe according to claim 20, wherein the first arm is coupled to the lower sole element at a medial side of the shoe, and wherein the deformation element extends from the second arm toward the lateral side of the shoe.

27. A shoe according to claim 20, wherein the first arm is coupled to the lower sole element at a lateral side of the shoe, and wherein the deformation element extends from the second arm toward the medial side of the shoe.

28. A shoe according to claim 20, wherein the angle is within a range of 5 degrees to 125 degrees.

29. A shoe according to claim 20, wherein the first and second arms are angled inward with respect to the shoe, thereby defining the fixed angle therebetween.

30. A shoe according to claim 1, wherein the first and second levers define a portion of an exterior side of a sole of the shoe.

31. A shoe according to claim 20, wherein the intersection of the first arm and the second arm is pivotably coupled about a fixed longitudinal axis of the shoe.

* * * * *

UNITED STATES PATENT AND TRADEMARK OFFICE

CERTIFICATE OF CORRECTION

PATENT NO. : 8,397,402 B2
APPLICATION NO. : 11/959041
DATED : March 19, 2013
INVENTOR(S) : Lucas et al.

It is certified that error appears in the above-identified patent and that said Letters Patent is hereby corrected as shown below:

On the Title Page, Item (54) and in the specification, Column 1, line 1, Title, "SHOE HAVING LEVERED CUSHIONING SYSTEM" should read --SHOE HAVING CUSHIONING SYSTEM--.

In the Claims:

At column 10, line 44 (claim 10): "wherein saidfirst and" should read --wherein said first and--.

At column 11, line 12 (claim 20): "upper sole element:" should read --upper sole element;--.

Signed and Sealed this
Second Day of July, 2013

Teresa Stanek Rea

Teresa Stanek Rea
*Acting Director of the United States Patent and Trademark Office*